US005398921A

United States Patent [19]

Emigh

[11] Patent Number: 5,398,921

[45] Date of Patent: Mar. 21, 1995

[54] CONTINUOUS PAPER FEEDER

[76] Inventor: Jon Emigh, 7050 Mt. Aukum Rd. #5, Somerset, Calif. 95684

[21] Appl. No.: 184,972

[22] Filed: Jan. 21, 1994

[51] Int. Cl.[6] ..... B65H 5/22

[52] U.S. Cl. ..... 271/3.1; 271/126; 271/161

[58] Field of Search ..... 271/212, 3.1, 31.1, 271/126, 161

[56] References Cited

U.S. PATENT DOCUMENTS

| | | | |
|---|---|---|---|
| 4,369,959 | 1/1983 | Hornbuckle . | |
| 4,415,263 | 11/1983 | Hoffman | 271/161 X |
| 4,456,235 | 6/1984 | Colgazier et al. . | |
| 4,478,404 | 10/1984 | Garavuso . | |
| 4,526,501 | 7/1985 | Blumle . | |
| 4,570,918 | 2/1986 | Eisler . | |
| 4,579,326 | 4/1986 | Pinckney et al. . | |
| 4,777,365 | 11/1988 | Torii | 271/3.1 X |
| 4,786,040 | 11/1988 | Thomson | 271/212 X |
| 4,966,521 | 10/1990 | Frye et al. . | |
| 5,026,037 | 6/1991 | Masuda . | |
| 5,145,163 | 9/1992 | Cowan | 271/161 |

*Primary Examiner*—David H. Bollinger
*Attorney, Agent, or Firm*—James M. Ritchey

[57] ABSTRACT

A continuous paper feeder for supplying sheets of paper to a receiving machine from a top of a first stack of paper while being resupplied to a bottom of the first stack of paper with sheets of paper from a top of a second stack of paper. A concave paper hopper maintains a generally constant angle of incidence of a leading edge of sheets of paper from the top of the first stack of paper to a picker of the receiving machine. Sheet feed belts transfer paper from the top of the second stack of paper to the bottom of the first stack of paper while sheets of paper are continually removed from the top of the first stack to the receiving machine by the picker.

15 Claims, 5 Drawing Sheets

CONTINUOUS PAPER FEEDER

BACKGROUND OF THE INVENTION

1. Field of the Invention

A partially automated paper feeder is related. More specifically, an operator assisted continuous paper feeder is disclosed that has a paper delivery channel or hopper curved to permit the operator to insert additional sheets of paper below a previous stack of sheets without altering the angle of incidence of the leading edge of the next delivered sheet to a picking head of a receiving machine.

2. Description of the Background Art

Paper delivery systems for various devices and of differing designs have been in existence for several decades. However, for photocopy and related machines, no easy to use, simply constructed, and reliable paper delivery system exists that can be continuously fed without the need of stopping the machine to load additional paper.

Specifically, U.S. Pat. No. 4,456,235 discloses a relatively complex bottom-up sheet stacker. In this device new sheets are added to a stack from the bottom while old sheets are being taken off the top.

U.S. Pat. No. 4,478,404 teaches a unit on top of a copy machine in which sheets of paper are fed to the bottom of an original stack. Below the original stack of sheets is a levitation pocket and a positive air pressure source to provide an air cushion between a stack tray and the bottom sheet in the stack. Drive belts deliver additional sheets into the levitation pocket and the positive air pressure places the additional sheets on the bottom of the original stack.

Related in U.S. Pat. No. 4,570,918 is a feeder and bottom stacker. A cushion of air is employed, in conjunction with a reversible drive roll mounted within a vacuum plenum, to remove or insert sheets of paper from or to a stack.

U.S. Pat. No. 5,026,037 presents a copying machine with multiple transport functions inclusive of duplex and composite copying from an intermediate feed tray by selecting top or bottom feeds. The paper tray has upper and lower rollers to remove top and bottom sheets.

A sheet feed machine is disclosed in U.S. Pat. No. 4,369,959. A drive belt is positioned beneath a stack of paper sheets and delivers sheets to a conveyor positioned to send the sheets into a receiving machine.

Furnished in U.S. Pat. No. 4,526,501 is a sheet pile replenishment apparatus. A rather complex apparatus supplies sheets via several component systems.

U.S. Pat. No. 4,966,521 recounts a tail stopping and knockdown device. Included are means for nipping the trailing edge of the sheets as they leave a high-speed conveyor system.

U.S. Pat. No. 4,579,326 divulges a compact document handling system. The system delivers paper that can be copied on both sides.

In total, the prior art fails to present a simple, efficient, and reliable means for delivering paper from a stack to a receiving machine.

SUMMARY OF THE INVENTION

An object of the present invention is to provide a paper feeder that can be resupplied with additional paper while continuously delivering sheets of paper to a receiving machine.

Another object of the present invention is to supply a paper feeder that allows an operator to manually introduce additional paper to stack of paper being delivered to a receiving machine without stopping the receiving machine.

A further object of the present invention is to disclose a paper feeder that produces a generally constant angle of incidence of a leading edge of paper to a picking head of a receiving machine.

Still another object of the present invention is to generate a paper feeder with a concave paper hopper that produced a generally constant angle of incidence of a leading edge of paper to a picking head of a receiving machine.

Yet a further object of the present invention is to furnish a simple apparatus for continuously resupplying paper to a receiving machine without wasting time halting the paper feeding process each time additional paper is required.

Disclosed is a continuous paper feeder for supplying sheets of paper to a receiving machine from a top of a first stack of paper while being resupplied to a bottom of the first stack of paper with sheets of paper from a top of a second stack of paper. Comprising the subject invention is a concave paper hopper for maintaining a constant angle of incidence of a leading edge of sheets of paper from the top of the first stack of paper to a picking means of the receiving machine. The hopper comprises a bottom plate with first and second ends and opposing side boundaries formed into a concave structure by a radiused section proximate the bottom plate first end. A side wall is associated with each of the bottom plate side boundaries.

Provided are means associated with the concave paper hopper for transferring within the concave paper hopper sheets of paper from the second stack of paper to the bottom of the first stack of paper while sheets of paper are continually removed from the top of the first stack to the receiving machine by the picking means. The transferring means comprise a plurality of channel apertures formed in the bottom plate proximate the first end and extending through the radiused section and toward the second end. A paper feed belt is mounted within each of the channel apertures. Means are included for activating the paper feed belts to transfer the sheets of paper from the second stack of paper to the bottom of the first stack of paper while sheets of paper are continually removed from the top of the first stack to the receiving machine by the picking means. The activation means comprises a motor synchronized with the machine picking means and coupled to the feed belts to transfer the sheets of paper from the second stack of paper to the bottom of the first stack of paper.

Other objects, advantages, and novel features of the present invention will become apparent from the detailed description that follows, when considered in conjunction with the associated drawings.

DESCRIPTION OF THE PREFERRED EMBODIMENT

Figure 1:
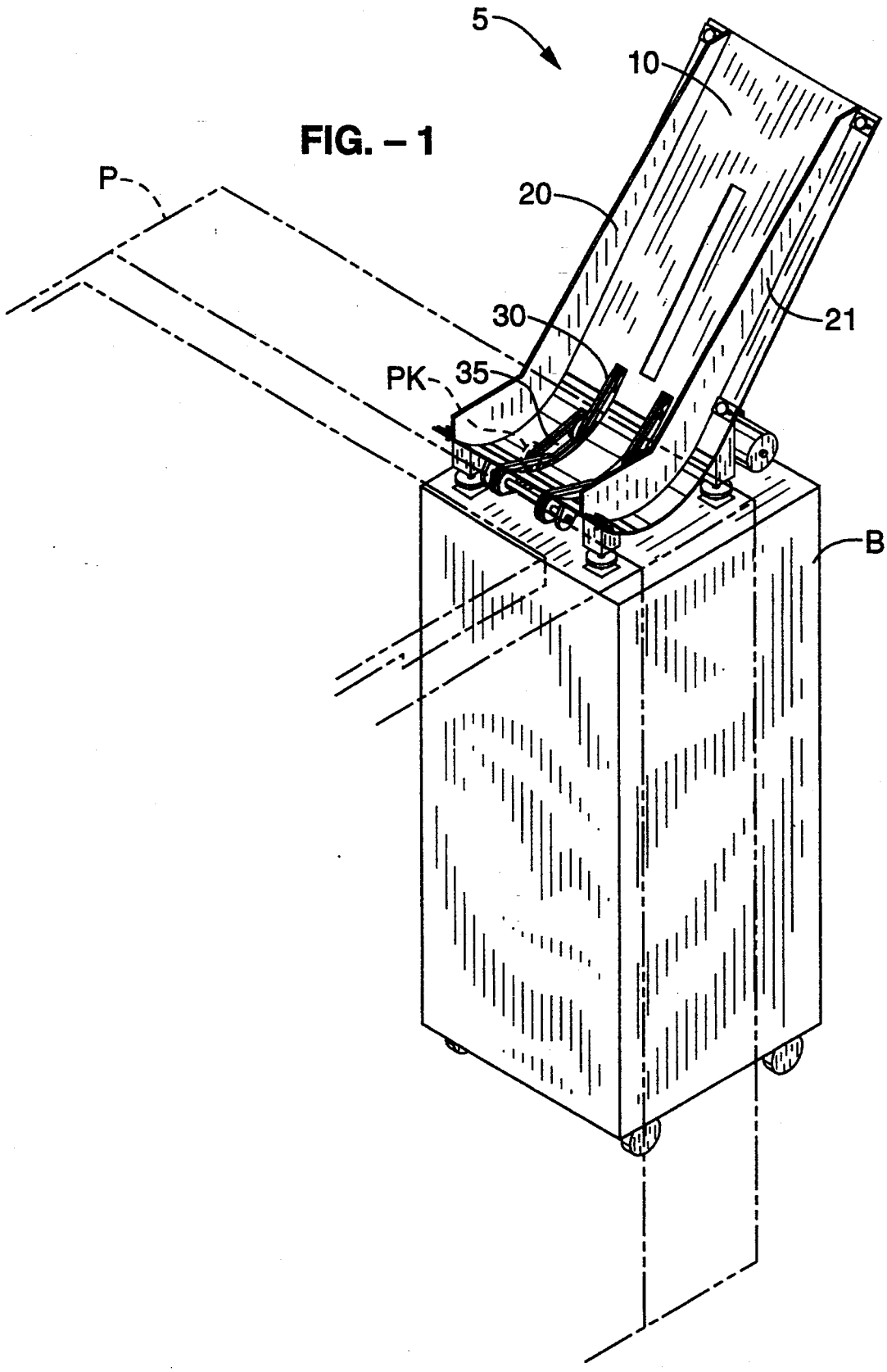
FIG. 1 is a perspective view of the subject apparatus mounted to a typical receiving machine or printer.
Figure 2:
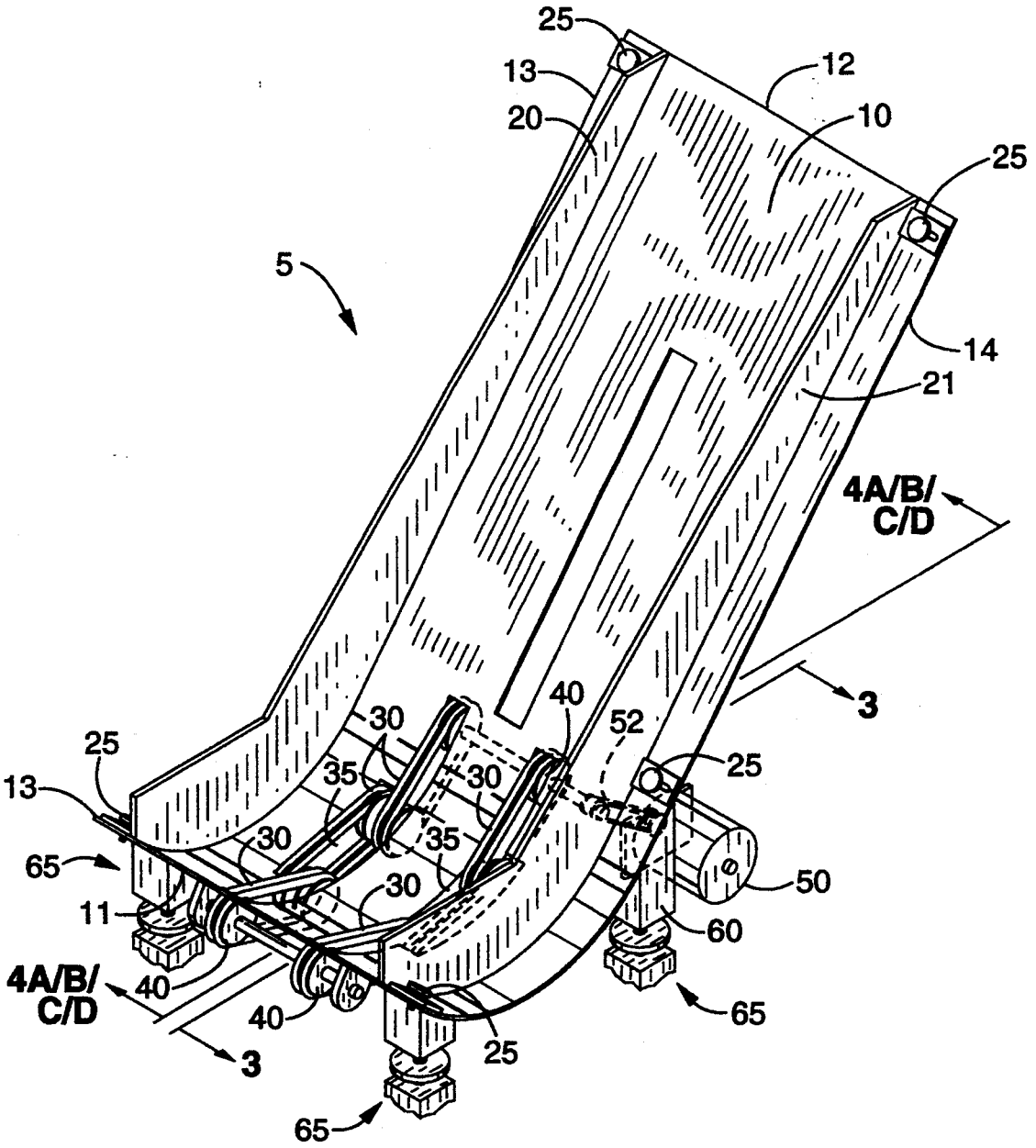
FIG. 2 is a perspective view of the subject apparatus.
Figure 3:
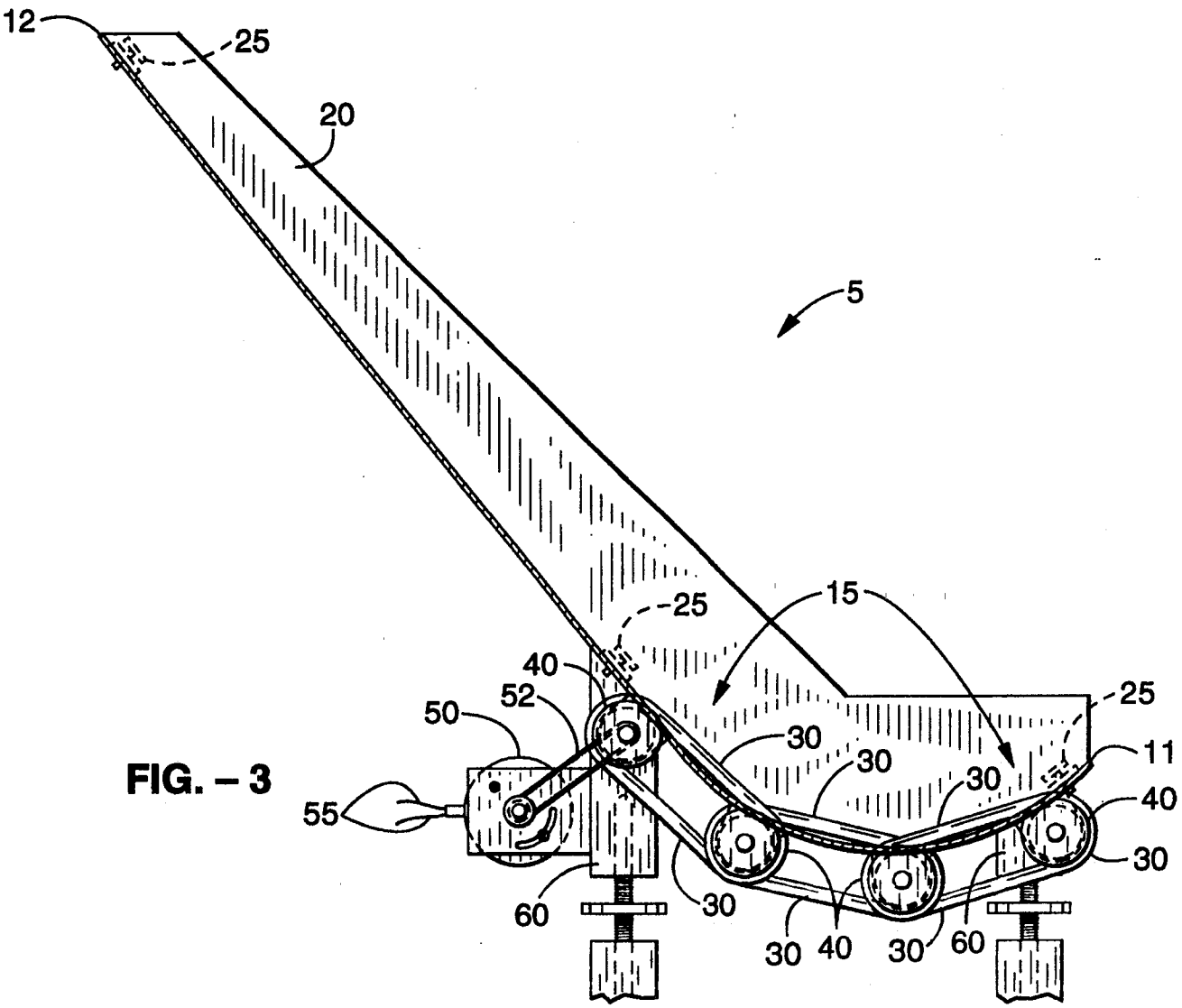
FIG. 3 is a side view of the subject apparatus.
Figures 4A, 4B:
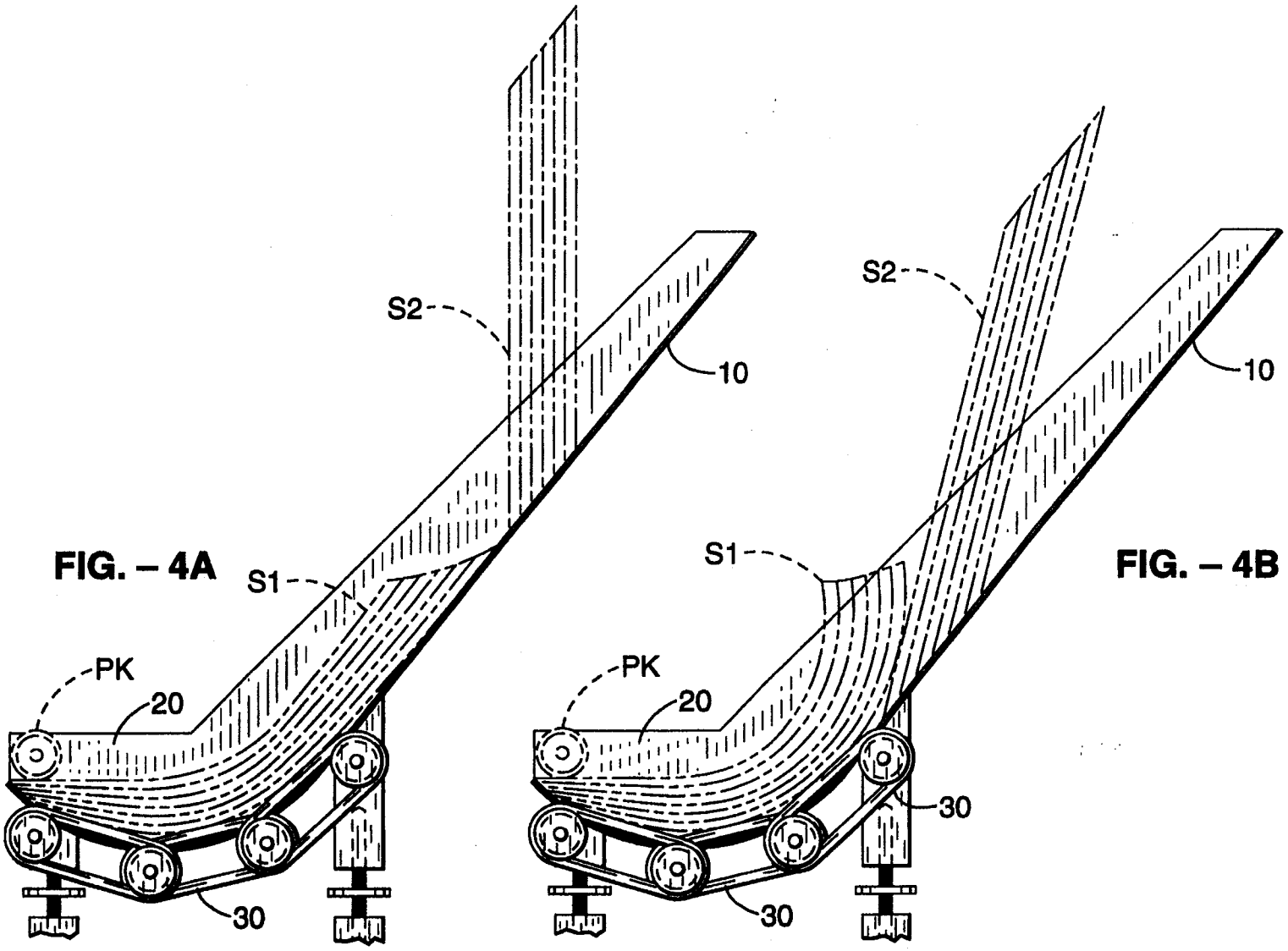
FIG. 4*a*–4*d* are cross sectional views of the subject apparatus showing the loading of paper into the subject hopper.
Figure 4D:
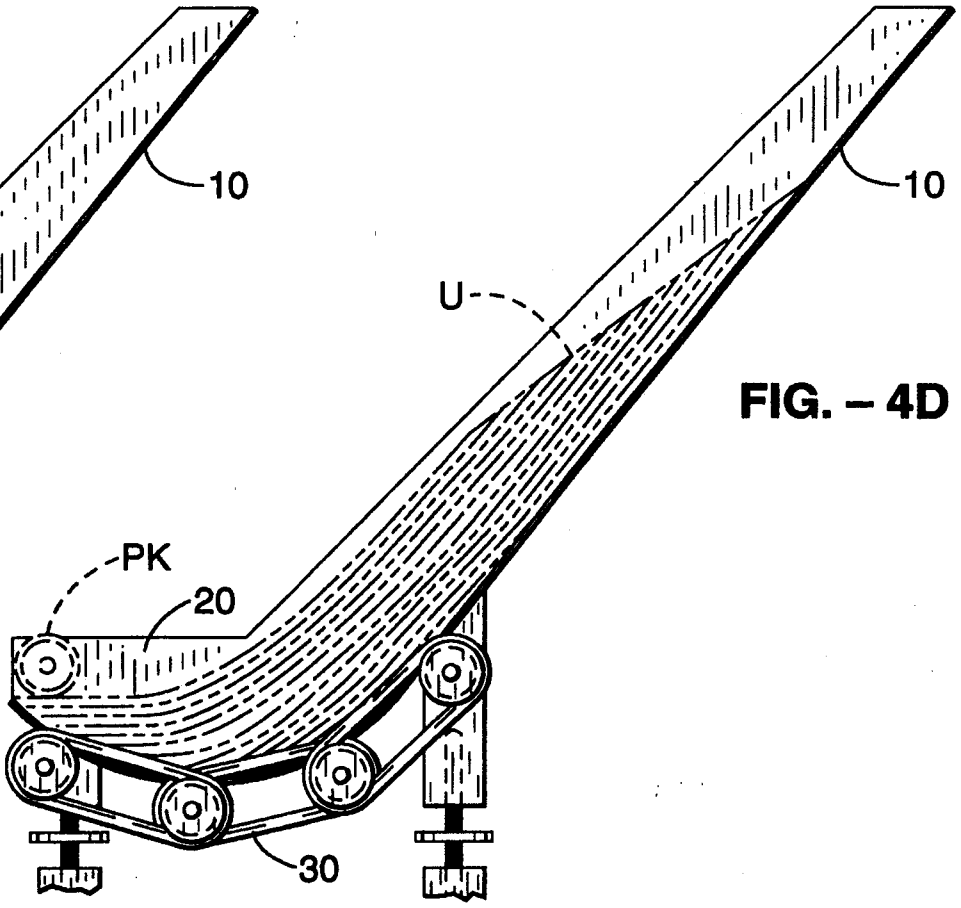
Figure 4C:
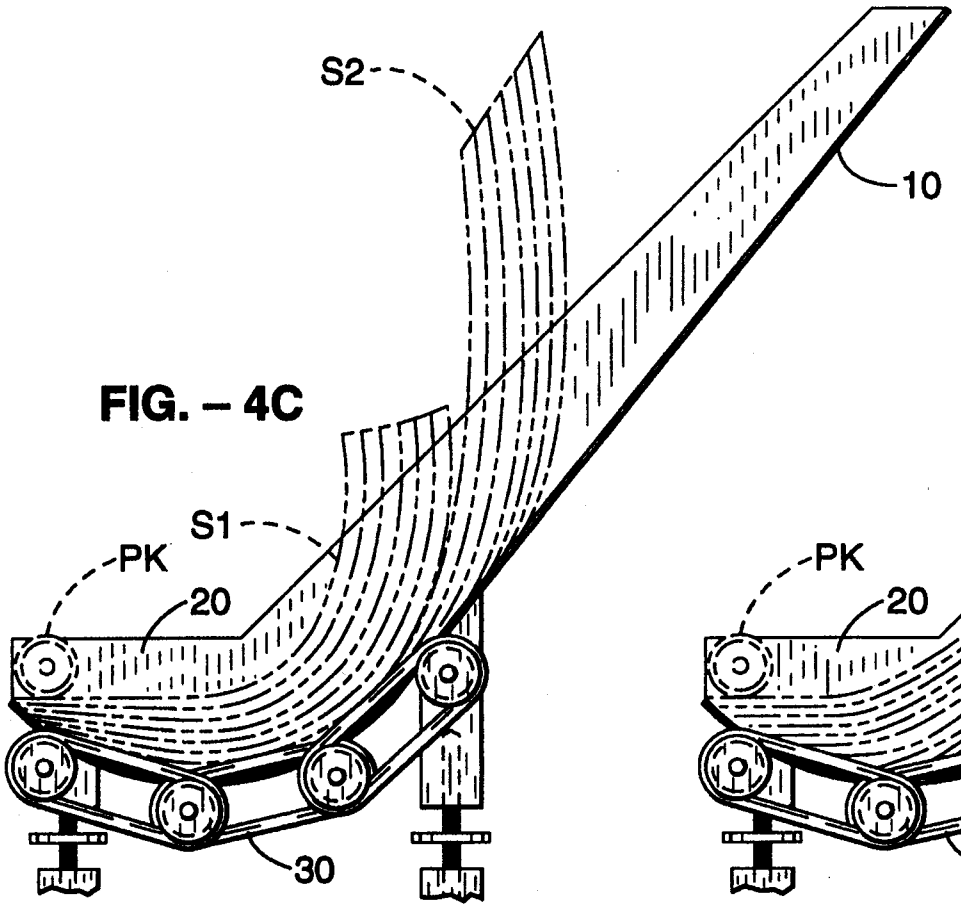

Specifically, referring now to FIGS. 1–4, there is shown a preferred embodiment of a continuous paper feeder 5. As seen in FIG. 1, the subject invention 5 is utilized to feed paper efficiently to a receiving device such as a printer P or machines that require sheets of paper or similar material. A simple motivating theory is behind the subject invention 5: that theory being that it is better to build a paper feeder that can be continually fed than to use an existing paper feeder system that is loaded, run until empty, shut down, reloaded with paper, started, and repeated over and over again until the job is completed. If the printing job comprises a large number of documents to be copied the stop-start scenario becomes a huge loss in time.

For exemplary purposes only, the receiving machine P will be considered to be a printer. The printer P has a picking means PK that is generally a wheel or belt that has sufficient frictional characteristic to draw in a page of paper it contacts upon command by a controlling mechanism. The incoming page of paper must be presented to the picking means PK in a suitable manner to allow for a proper frictional interaction.

The subject apparatus 5 is generally mounted on or to a suitable means such as a movable support or base B, although a nonmovable mounting means is within the realm of this disclosure. The base B mates the subject feeder 5 sufficiently close to the picker means PK of the receiving machine P to permit the picker means PK to contact and remove pages of paper when instructed to do so by the receiving machine's controlling mechanism. Preferably, included in the base B or the feeder 5 are means for anchoring the feeder 5 in a stable relational position to the printer P to permit paper withdrawal without unintentionally separating the feeder 5 from the primer P. Anchoring means include clips, screws, bolts, latches, and equivalent devices.

Provided are means for maintaining a generally constant angle of incidence AI (see FIG. 4*a*) of a leading edge of sheets of paper to the picking means PK. When stacked paper contacts the picking means PK the entry angle or angle of incidence AI needs to be relatively constant to assure proper page delivery. Depending upon the exact requirements of the picking means PK, the angle of incidence AI may vary. The means for maintaining the needed angle of incidence AI is the form of a concave paper hopper. The concave paper hopper is comprised of a concave bottom plate 10 with first 11 and second 12 ends and opposing side boundaries 13 and 14. The bottom plate 10 is formed into a concave structure by a radiused section 15 (see FIG. 3) that is positioned proximate the bottom plate first end 11.

Further comprising the hopper are a pair of opposing side walls 20 and 21. The side walls 20 and 21 are formed to follow the contours of the bottom plate side boundaries 13 and 14. The side walls are secured to the bottom plate 10 by appropriate means such as the illustrated thumb screw mechanisms 25 or equivalent means such as welding, extruding, gluing, and the like and may be formed as an integral part of the bottom plate 10 and bent in a suitable direction to form the hopper.

The hopper is fabricated from suitable materials such as metals or synthetic or natural polymers.

The subject apparatus 5 provides means associated with the angle maintaining means or hopper for transferring sheets of paper to the bottom of a first stack of paper from the top of a second stack of paper while sheets of paper are continually removed from the top of the first stack of paper and delivered to the receiving printer P. The paper sheet transferring means comprises at least one paper feed belt associated with the hopper. Included are means for activating the feed belt to transfer the sheets of paper from the second stack of paper to the bottom of the first stack of paper while sheets of paper are continually removed from the top of the first stack to the receiving machine P by the picking means PK. Usually, a plurality of paper feed belts 30 are mounted in channel apertures 35 formed in the bottom plate 10. Although belts are preferred, other means such as wheels and the like are within the domain of this disclosure. Each channel aperture 35 is formed in the bottom plate 10 proximate the first end 11 and extending through the radiused section 15 and toward the second end 12. The channel aperture is usually continuous, but may be a series of apertures or equivalent structures.

The paper feed belts 30 are mounted to the bottom plate by appropriate wheel mechanisms 40 that permit the belts to rotate within the length of the channel apertures. The surface of the feeder belts 30 extend past the upper surface of the bottom plate 10 to permit the belts 30 to contact any sheets of paper within the hopper. As seen in the figures four wheel mechanisms 40 hold six feed belts 30 in each channel aperture 35. Other equivalent numbers of wheel mechanisms 40, channel apertures 35, and belts 30 are considered to be within the realm of this disclosure.

Specifically, the means for activating the feed belt or belts 30 to transfer the sheets of paper from the second stack of paper to the bottom of the first stack of paper while sheets of paper are continually removed from the top of the first stack to the receiving machine P by the picking means PK comprises a drive motor 50 and associated coupling means such as a drive belt 52 or equivalent mechanism. The drive motor 50 is linked via electrical connectors 55 to the controller of the receiving device that powers the picking means PK and synchronized to activate the feed belt 30 when additional sheets of paper are required. The motor 50 is secured to the hopper by suitable means such as a bracket 60.

The hopper is leveled and configured for the picking belt or wheel PK by adjusting means. The adjusting means allows the operator to manipulate the feed angle and height of the hopper for different picking characteristics. Usually, four finger wheel adjustment jacks 65 on the bottom plate 10 are utilized. These jacks 65 allow the operator to adjust the hopper to produce an appropriate feed angle and height for different picking characteristics associated with various printers (receiving machined), paper quality, and the like.

Preferably and in particular, the operation of the subject apparatus 5 is seen in FIGS. 4*a*–4*d*. The subject feeder 5 prebends a first stack of paper stock S1 in such a way that the back edge of the first paper stack S1 can be bent up without changing the angle of incidence AI of the leading edge of the first paper stack S1 to the picking means PK of the receiving machine. This constant angle of incidence for the leading edge of the first stack S1 allows an operator to load in a second stack of paper S2 into the hopper, below the existing stack S1, without stopping the picking head PK from pulling paper from the leading edge of the stack (see FIG. 4*b* for an illustration of the second stack S2 being slipped under the first stack S1). Clearly, additional stacks of paper (further S2s) can be added to the existing stack (pre-existing stack S1) within the feeder to continue the process.

In view of FIGS. 4a–4d, the operating principle of the subject continuous paper feeder 5 is that the bottom feed belts 30 in the paper hopper pull newly loaded paper S2 into the bottom of the pre-existing stack of paper S1 which forces the stack S1 up against the picking head PK. Because of the down angle of the subject feeder hopper, the top sheets of the first stack S1 always stay against the picking means or head PK, in position for the picking head PK to pull the next sheet from the first stack S1.

The radiused bottom of the paper hopper is the feature that transfers a shingled stack of paper into the equivalent of a vertical stack. As the shingled stack of sheets is pulled up and around the radiused leading edge, the frictional forces of the drive belts 30 are transformed from a generally horizontal or angled force into a generally vertical force that pushes the top sheets of the first stack S1 against the picking means PK (as indicated, usually a belt or wheel) of the receiving machine.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A continuous paper feeder for supplying sheets of paper to a receiving machine from a top of a first stack of paper while being resupplied to a bottom of the first stack of paper with sheets of paper from a top of a second stack of paper, comprising:

a) a concave paper hopper for maintaining a constant angle of incidence of a leading edge of sheets of paper from the top of the first stack of paper to a picking means of the receiving machine and b) means associated with said concave paper hopper for transferring within said concave paper hopper sheets of paper from the second stack of paper to the bottom of the first stack of paper while sheets of paper are continually removed from the top of the first stack to the receiving machine by said picking means.

2. A continuous paper feeder according to claim 1, wherein said concave paper hopper comprises:

a) a concave bottom plate and b) a pair of opposing side walls associated with said concave bottom plate.

3. A continuous paper feeder according to claim 1, wherein said concave paper hopper comprises:

a) a bottom plate with first and second ends and opposing side boundaries formed into a concave structure by a radiused section proximate said bottom plate first end and b) a side wall associated with each of said bottom plate side boundaries.

4. A continuous paper feeder according to claim 1, wherein said paper sheet transferring means comprises:

a) a paper feed belt associated with said concave paper hopper and b) means for activating said feed belt to transfer said sheets of paper from the second stack of paper to the bottom of the first stack of paper while sheets of paper are continually removed from the top of the first stack to the receiving machine by said picking means.

5. A continuous paper feeder according to claim 1, wherein said paper sheet transferring means comprises:

a) a plurality of paper feed belts associated with said concave paper hopper and b) means for activating said plurality of feed belts to transfer said sheets of paper from the second stack of paper to the bottom of the first stack of paper while sheets of paper are continually removed from the top of the first stack to the receiving machine by said picking means.

6. A continuous paper feeder for supplying sheets of paper to a receiving machine from a top of a first stack of paper while being resupplied to a bottom of the first stack of paper with sheets of paper from a top of a second stack of paper, comprising:

a) a concave paper hopper for maintaining a constant angle of incidence of a leading edge of sheets of paper from the top of the first stack of paper to a picking means of the receiving machine comprising:

a bottom plate with first and second ends and opposing side boundaries formed into a concave structure by a radiused section proximate said bottom plate first end and a side wall associated with each of said bottom plate side boundaries and b) means associated with said concave paper hopper for transferring within said concave paper hopper sheets of paper from the second stack of paper to the bottom of the first stack of paper while sheets of paper are continually removed from the top of the first stack to the receiving machine by said picking means.

7. A continuous paper feeder according to claim 6, wherein said paper sheet transferring means comprises:

a) a paper feed belt associated with said concave paper hopper and b) means for activating said feed belt to transfer said sheets of paper from the second stack of paper to the bottom of the first stack of paper while sheets of paper are continually removed from the top of the first stack to the receiving machine by said picking means.

8. A continuous paper feeder according to claim 6, wherein said paper sheet transferring means comprises:

a) a plurality of paper feed belts associated with said concave paper hopper and b) means for activating said plurality of feed belts to transfer said sheets of paper from the second stack of paper to the bottom of the first stack of paper while sheets of paper are continually removed from the top of the first stack to the receiving machine by said picking means.

9. A continuous paper feeder according to claim 6, wherein said paper sheet transferring means comprises:

a) a channel aperture formed in said bottom plate proximate said first end and extending through said radiused section and toward said second end;

b) a paper feed belt mounted within said channel aperture and c) means for activating said paper feed belt to transfer said sheets of paper from the second stack of paper to the bottom of the first stack of paper while sheets of paper are continually removed from the top of the first stack to the receiving machine by said picking means.

10. A continuous paper feeder according to claim 6, wherein said paper sheet transferring means comprises:

a) a plurality of channel apertures formed in said bottom plate proximate said first end and extending through said radiused section and toward said second end;

b) a paper feed belt mounted within each of said channel apertures and c) means for activating said paper feed belts to transfer said sheets of paper from the second stack of paper to the bottom of the first stack of paper while sheets of paper are continually removed from the top of the first stack to the receiving machine by said picking means.

11. A continuous paper feeder for supplying sheets of paper to a receiving machine from a top of a first stack of paper while being resupplied to a bottom of the first stack of paper with sheets of paper from a top of a second stack of paper, comprising:

a) a concave paper hopper for maintaining a constant angle of incidence of a leading edge of sheets of paper from the top of the first stack of paper to a picking means of the receiving machine comprising:

a bottom plate with first and second ends and opposing side boundaries formed into a concave structure by a radiused section proximate said bottom plate first end and a side wall associated with each of said bottom plate side boundaries and b) means associated with said concave paper hopper for transferring within said concave paper hopper sheets of paper from the second stack of paper to the bottom of the first stack of paper while sheets of paper are continually removed from the top of the first stack to the receiving machine by said picking means comprising :

a channel aperture formed in said bottom plate proximate said first end and extending through said radiused section and toward said second end;

a paper feed belt mounted within said channel aperture and means for activating said paper feed belt to transfer said sheets of paper from the second stack of paper to the bottom of the first stack of paper while sheets of paper are continually removed from the top of the first stack to the receiving machine by said picking means.

12. A continuous paper feeder according to claim 11, wherein said activating means comprises a motor synchronized with said machine picking means and coupled to said feed belt to transfer said sheets of paper from the second stack of paper to the bottom of the first stack of paper.

13. A continuous paper feeder for supplying sheets of paper to a receiving machine from a top of a first stack of paper while being resupplied to a bottom of the first stack of paper with sheets of paper from a top of a second stack of paper, comprising:

a) a concave paper hopper for maintaining a constant angle of incidence of a leading edge of sheets of paper from the top of the first stack of paper to a picking means of the receiving machine comprising:

a bottom plate with first and second ends and opposing side boundaries formed into a concave structure by a radiused section proximate said bottom plate first end and a side wall associated with each of said bottom plate side boundaries and b) means associated with said concave paper hopper for transferring within said concave paper hopper sheets of paper from the second stack of paper to the bottom of the first stack of paper while sheets of paper are continually removed from the top of the first stack to the receiving machine by said picking means comprising:

a plurality of channel apertures formed in said bottom plate proximate said first end and extending through said radiused section and toward said second end;

a paper feed belt mounted within each of said channel apertures and means for activating said paper feed belts to transfer said sheets of paper from the second stack of paper to the bottom of the first stack of paper while sheets of paper are continually removed from the top of the first stack to the receiving machine by said picking means.

14. A continuous paper feeder according to claim 13, wherein said activating means comprises a motor synchronized with said machine picking means and coupled to said feed belts to transfer said sheets of paper from the second stack of paper to the bottom of the first stack of paper.

15. A continuous paper feeder for supplying sheets of paper to a receiving machine from a top of a first stack of paper while being resupplied to a bottom of the first stack of paper with sheets of paper from a top of a second stack of paper, comprising:

a) a concave paper hopper for maintaining a constant angle of incidence of a leading edge of sheets of paper from the top of the first stack of paper to a picking means of the receiving machine comprising:

a bottom plate with first and second ends and opposing side boundaries formed into a concave structure by a radiused section proximate said bottom plate first end and a side wall associated with each of said bottom plate side boundaries and b) means associated with said concave paper hopper for transferring within said concave paper hopper sheets of paper from the second stack of paper to the bottom of the first stack of paper while sheets of paper are continually removed from the top of the first stack to the receiving machine by said picking means comprising:

a plurality of channel apertures formed in said bottom plate proximate said first end and extending through said radiused section and toward said second end;

a paper feed belt mounted within each of said channel apertures and means for activating said paper feed belts to transfer said sheets of paper from the second stack of paper to the bottom of the first stack of paper while sheets of paper are continually removed from the top of the first stack to the receiving machine by said picking means comprising a motor synchronized with said machine picking means and coupled to said feed belts to transfer said sheets of paper from the second stack of paper to the bottom of the first stack of paper.

* * * * *